US010920768B2

(12) United States Patent
Carman et al.

(10) Patent No.: US 10,920,768 B2
(45) Date of Patent: Feb. 16, 2021

(54) PUMP DRIVE THAT MINIMIZES A PULSE WIDTH BASED ON VOLTAGE DATA TO IMPROVE INTAKE AND DISCHARGE STROKES

(71) Applicant: Milton Roy, LLC, Ivyland, PA (US)

(72) Inventors: Jason Carman, Gardner, KS (US); Nile Fairfield, Prairie Village, KS (US)

(73) Assignee: Milton Roy, LLC, Ivyland, PA (US)

( * ) Notice: Subject to any disclaimer, the term of this patent is extended or adjusted under 35 U.S.C. 154(b) by 332 days.

(21) Appl. No.: 15/824,723

(22) Filed: Nov. 28, 2017

(65) Prior Publication Data

US 2019/0078565 A1 Mar. 14, 2019

Related U.S. Application Data

(60) Provisional application No. 62/558,486, filed on Sep. 14, 2017.

(51) Int. Cl.
*F04B 49/06* (2006.01)
*F04B 49/03* (2006.01)
(Continued)

(52) U.S. Cl.
CPC ..... *F04B 49/065* (2013.01); *F04B 17/04* (2013.01); *F04B 35/045* (2013.01);
(Continued)

(58) Field of Classification Search
CPC ..... F04B 45/027; F04B 2203/0409; F04B 2203/0405
See application file for complete search history.

(56) References Cited

U.S. PATENT DOCUMENTS 4,812,945 A * 3/1989 D'Onofrio ..... H01H 47/22 361/154
5,017,854 A 5/1991 Gully et al.
(Continued)

FOREIGN PATENT DOCUMENTS

GB 1567041 A 5/1980
JP S6325382 A 2/1988
JP 3602256 B2 12/2004

OTHER PUBLICATIONS

Extended European Search Report dated Feb. 4, 2019 for Application No. 18194364.8, 8 pages.

*Primary Examiner* — Bryan M Lettman
*Assistant Examiner* — Timothy P Solak
(74) *Attorney, Agent, or Firm* — Edell, Shapiro & Finnan, LLC

(57) ABSTRACT

The performance of a solenoid drive liquid pump can be very dependent on the magnitude and stability of an input voltage, with non-ideal input power resulting in loss of efficiency and potential damage to the pump. Pulse width of drive signals provided to the pump, which cause solenoids to alternately energize to move liquid through the pump, may be adjusted in duration in order to compensate for non-ideal input voltage. A drive control module of the pump gathers voltage information, determines an improved pulse width based upon that voltage information, and then provides drive signals based upon the improved pulse width. Operating in this manner, a pump can operate at or near peak efficiency despite both significant variances in input voltage and non-sinusoidal input voltage, and without customized components or adapters.

16 Claims, 5 Drawing Sheets

(51) Int. Cl.

| | |
|---|---|
| ***F04B 17/04*** | (2006.01) |
| ***F04B 35/04*** | (2006.01) |
| ***F04B 45/047*** | (2006.01) |
| ***F04B 49/20*** | (2006.01) |
| ***F04B 49/12*** | (2006.01) |
| ***F04B 49/16*** | (2006.01) |
| ***F04B 43/00*** | (2006.01) |
| ***F04B 13/00*** | (2006.01) |
| ***F04B 43/04*** | (2006.01) |

(52) U.S. Cl.

CPC ..... *F04B 45/047* (2013.01); *F04B 49/03* (2013.01); *F04B 49/12* (2013.01); *F04B 49/16* (2013.01); *F04B 49/20* (2013.01); *F04B 13/00* (2013.01); *F04B 43/0081* (2013.01); *F04B 43/04* (2013.01); *F04B 2201/0202* (2013.01); *F04B 2201/0206* (2013.01); *F04B 2203/0402* (2013.01); *F04B 2203/0405* (2013.01); *F04B 2203/0409* (2013.01); *F04B 2205/03* (2013.01)

(56) References Cited

U.S. PATENT DOCUMENTS

| | | | | |
|---|---|---|---|---|
| 5,597,051 | A * | 1/1997 | Moriya | F01M 1/16 123/196 R |
| 6,024,071 | A * | 2/2000 | Heimberg | F02D 41/20 123/490 |
| 6,280,147 | B1 | 8/2001 | Kilayko et al. | |
| 2003/0164691 | A1* | 9/2003 | Ueda | F04B 35/045 318/135 |
| 2004/0146417 | A1* | 7/2004 | Dunn | F04B 17/046 417/417 |
| 2006/0251523 | A1* | 11/2006 | Lee | F04B 35/045 417/44.1 |
| 2013/0092704 | A1* | 4/2013 | Tincher | D06F 33/00 222/1 |

* cited by examiner

PUMP DRIVE THAT MINIMIZES A PULSE WIDTH BASED ON VOLTAGE DATA TO IMPROVE INTAKE AND DISCHARGE STROKES

CROSS REFERENCE TO RELATED INFORMATION

This application claims the benefit of U.S. Provisional Patent Application No. 62/558,486, filed Sep. 14, 2017, titled Dynamic Solenoid Drive Duty Cycle Adjustment, the contents of which are hereby incorporated herein in its entirety.

TECHNICAL FIELD

The present disclosure is directed to a system and method for dynamically adjusting drive duty cycle to account for varying conditions of power input to a pump.

BACKGROUND OF THE INVENTION

Positive displacement solenoid drive pumps operate by energizing a coil to create a magnetic field that moves a shaft within the pump. The movement of the shaft within a chamber of the pump can displace liquids or gases within chamber by, for example, the movement of a plunger or diaphragm attached to the shaft drawing liquid into the pumping chamber through an inlet check valve or forcing liquid from the pumping chamber through an outlet check valve. The displacement caused by the plunger or diaphragm itself creates areas of low pressure unseating the inlet check valve to allow the liquid to enter the pumping chamber, or, forces liquid from the chamber by forcing the outlet check valve open from the high pressure in the chamber. This is caused by the expansion and retraction of a diaphragm or displacement of the plunger within the chamber, which changes the overall volume of the chamber, thereby creating areas of low pressure or forcing liquid from the chamber. As the shaft moves in a first direction relative to the chamber during an intake stroke, the volume of the chamber increases and an area of low pressure is created within the chamber. As a result, an inlet check valve allows water to flow into the chamber as the pressure balances. As the shaft moves in a second and opposite direction during a discharge stroke, the volume of the chamber decreases. As a result, the inlet check valve closes and the water is pushed out an outlet check valve.

Often, the input voltage to a coil that creates the magnetic field, and the resulting intake stroke or discharge stroke, is a derivative of the supply voltage of a power source available to the pump in a particular installation. This could include, for example, differing input voltages for different applications (e.g., a permanent installation versus a temporary installation), different geographical locations (e.g., within the United States versus Europe), and different power sources (e.g., electrical grid versus a generator or battery). The coil requires a specific amount of energy to perform a complete intake stroke or discharge stroke. Lower supply voltages will often need to have a longer drive signal duration to fully engage the shaft, while higher supply voltages will require a shorter duration drive signal to fully engage the shaft. Precise shaft engagement is desirable and can contribute to the performance, efficiency, and longevity of the pump.

In addition to variations in stable input voltage, some power sources may have noisy or unstable power input resulting in non-sinusoidal voltage waveforms. The total energy delivered by a noisy waveform may different than that delivered by a clean waveform of equal peak-to-peak voltage. As a result, solenoid pumps connected to such a power source may require a longer or shorter duration drive signal in order to fully engage as compared to a similar pump connected to a power source with a clean sinusoidal waveform.

The duration of the drive signal should be as short as possible while still fully engaging the solenoid, in order to reduce thermal rise and increase pump efficiency. Typically, the solution for addressing non-sinusoidal waveforms or steady voltage mismatch is to create a different power supply and electronics for each voltage region or application or to include a universal power supply that generates a constant DC voltage in order to drive the solenoid regardless of conditions. These solutions may increase the cost of designing, developing, and certifying a pump (e.g., multiple pumps must be designed and separately certified for each scenario versus designing a single universal pump), as well as manufacturing, selling and supporting a pump (e.g., manufacturers or suppliers must build a different pump for each region and scenario, market them differently, provide different manuals and support services, for each, etc.). What is needed then is a system and method for adapting pump drive signal duration based on input voltage that does not rely on scenario specific power supplies or universal DC power supplies.

BRIEF SUMMARY OF THE INVENTION

The disclosed system and method for adapting pump drive signal duration based on input voltage comprises a shaft driven pump having a drive control module configured to determine an appropriate drive signal duration based on input voltage. In some implementations, the drive control module is configured to measure input voltage and determine whether it is clean (e.g., sinusoidal) or dirty (e.g., non-sinusoidal) based upon a means squared error calculation. Based on that determination, the drive control module may select a clean power equation for determining appropriate pulse width, or a dirty power equation for determining appropriate pulse width.

Some implementations may use other methods for determining pulse width, which could include a root mean squared calculation, a feedback loop examining and reacting to drive characteristics, or other similar methods. Some implementations may include two or more of the described or similar methods for determining pulse width. Once an appropriate pulse width is determined, a drive signal for that pulse width is supplied to the pumps drive.

An implementation using one or more of the above methods for determining an appropriate pulse width will be capable of automatically or manually adapting to a variety of power sources and conditions without specialized hardware. As a result, efficiency and longevity of the pump can be increased while minimizing the impact on overall cost.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
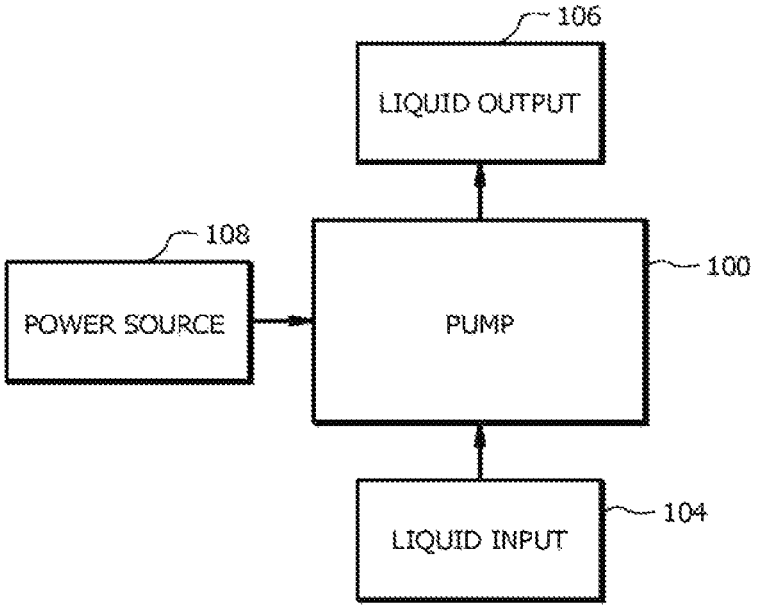
FIG. 1 is a schematic diagram showing an exemplary pump installation.

Referring now to FIG. 1, that figure is a schematic diagram showing an exemplary pump installation. Placement of the pump will depend upon a variety of factors, and may include, for example, considerations of the source of liquid that will be the liquid input (104) to the pump, the location where liquid will be pumped to as a liquid output (106), an available power source, and the form factor and other characteristics of the pump (e.g., whether it is designed to be horizontally or vertically mounted or placed, whether it is designed to be fully or partially submerged in liquid, whether the liquid input (104) is pulled through a hose attached to the pump (100), and other considerations). For the purposes of this disclosure, the pump (100) will be generally discussed as a solenoid driven diaphragm displacement pump. However, it should be understood that some or all of the concepts discussed herein will apply equally to a variety of pumps, including but not limited to plunger displacement pumps, piston displacements pumps, bellows displacement pumps, and other displacement and non-displacement pumps where improved timing for an intake cycle and a discharge cycle are desirable.

The power source (108) will also vary by installation, and may include a variety of different voltage characteristics depending upon such factors as geographic region, application, industry, and other factors. The voltage supplied by standard power grids in different areas of the world can vary between about 100 volts and about 240 volts, while portable generators and batteries can have even greater variance in both peak voltage and mean voltage.

The liquid input (104) may be any type of liquid that a particular pump (100) is designed to displace, and may be drawn into the pump (100) via a hose or other extension, or may in some cases be drawn directly into the pump (100) via an intake on the pump (100) housing or exterior. The liquid output (106) may be any container or area that displaced liquid is directed to from a hose or other outlet from the pump (100).

Figure 2:
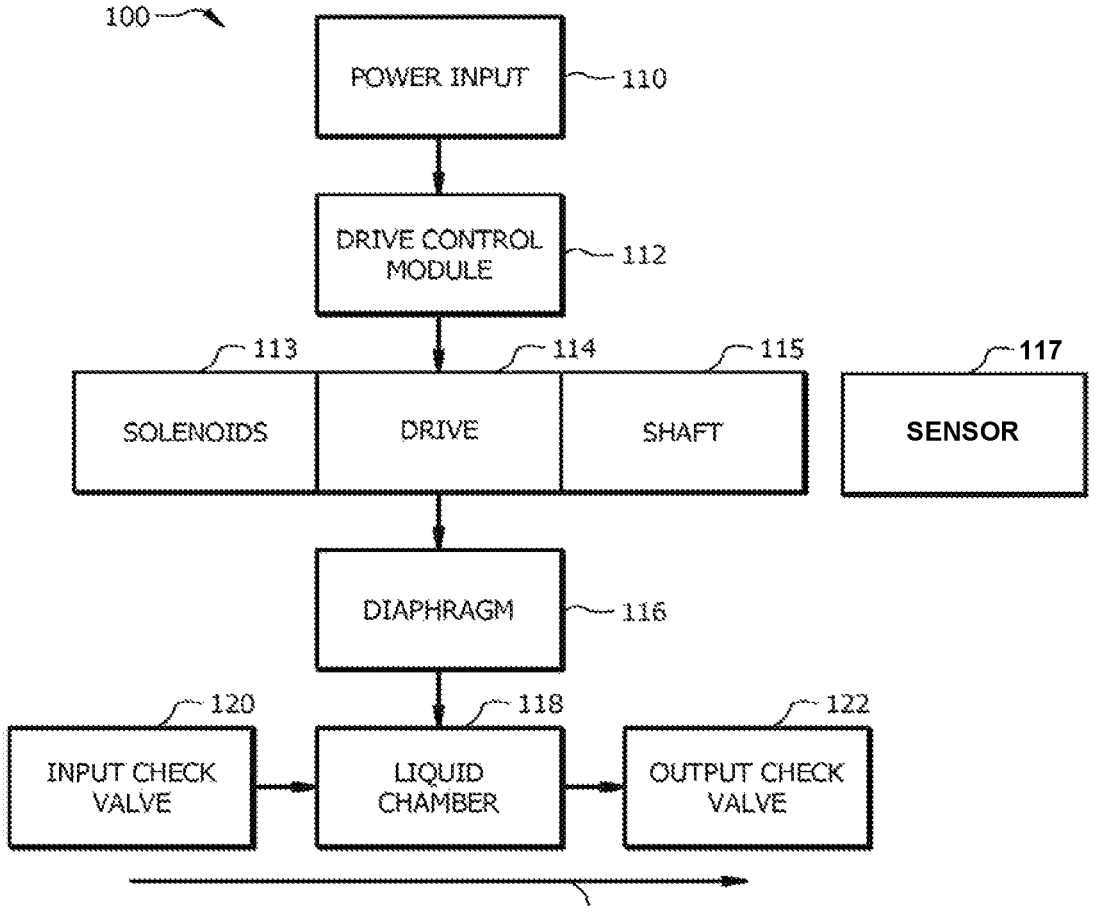
FIG. 2 is a schematic diagram for an exemplary shaft driven positive displacement pump.

Referring now to FIG. 2, that figure is a schematic diagram for an exemplary shaft driven positive displacement diaphragm pump that would be suitable for use as the pump (100) of FIG. 1. The exemplary pump (100) comprises a power input (110) configured to receive power from the power source (108). A drive control module (112) is configured to determine characteristics of the power received via the power input (110), determine drive signals based upon those characteristics, and control the pump's drive (114) with those drive signals. The drive (114) for the pictured solenoid displacement pump comprises two or more solenoids (113) and a shaft (115) positioned so that alternately energizing one of the two or more solenoids (113) causes the shaft (115) to move under magnetic forces generated by the energized solenoid (113) coils, alternately, in a first direction and a second direction. The drive (114) is configured to change the shape and position of a diaphragm (116) to which it is attached, which may be a sealed flexible membrane, as the shaft (115) moves in the first direction and the second direction.

The changing shape and position of the diaphragm (116) causes an increase and a decrease in the overall volume of the liquid chamber (118). For example, as the drive (114) moves the shaft (115) in a first direction away from the liquid chamber (118), the diaphragm (116) will flex in that direction causing the volume of the liquid chamber (118) to increase relative to its volume at a neutral position. As the drive (114) moves the shaft (115) in the second direction towards the liquid chamber (118), the diaphragm (116) will flex in that direction causing the volume of the liquid chamber (118) to decrease relative to its volume at a neutral position.

The pump also comprises an input check valve (120) and an output check valve (122) attached to the liquid chamber (118). The input check valve may be any type of unidirectional flow valve that will automatically open and allow liquid to flow into the liquid chamber (118) when an area of low pressure exists within the liquid chamber (118). In particular, when the volume of the liquid chamber (118) increases as a result of the flexing diaphragm (116) a low-pressure area is created that then fills with liquid from the liquid input (104) via the input check valve (120). One common type of input check valve (120) is a rubber plunger and spring that seals against an opening of the liquid chamber (118) by force of the spring when it is at a normal or high pressure. Another type of input check valve (120) is a ball type check valve that contains a buoyant ball that is movable within a chamber of the valve, and which can be sealed against an opening of the liquid chamber (118) whenever the flow of liquid moving through the valve (120) reverses direction.

The output check valve (122) is similar to the input check valve (120) but opens in the opposite circumstances, specifically, when the liquid chamber (118) is under a high pressure as a result of the diaphragm (116) flexing and reducing the overall volume of the liquid chamber (118). As with the input check valve (120), the output check valve (122) may be a rubber plunger and spring mechanism that opens when the liquid chamber (118) is at a high pressure, and seals against an opening of the liquid chamber (118) by the force of the spring when the liquid chamber (118) is at a low or normal pressure.

Based on the above, it can be seen that when the drive control module (112) provides drive signals to the drive (114), it causes the solenoids (113) to alternately energize and move the drive's (114) shaft (115) through an alternating intake stroke and discharge stroke. On the intake stroke, the size of the liquid chamber (118) increases due to the flex of the diaphragm (116) resulting in a flow of liquid through the input check valve (120) in the flow direction (124). On the discharge stroke, the size of the liquid chamber (118) decreases due to the flex of the diaphragm (116) resulting in a flow of liquid through the output check valve (122) also in the flow direction (124). In the context of the described pump (100), it can also be seen that failure to complete an intake stroke or a discharge stroke due to insufficient energizing of the drive (114) solenoids (113) will reduce the maximum change in the volume of the liquid chamber (118), thereby reducing the volume of liquid that passes through the input check valve (120) and the output check valve (122) on each drive cycle, resulting in less efficient operation. In the opposite scenario, where the drive (114) solenoids (113) are over-energized during the intake stroke and discharge stroke, additional stress is placed on the pump (100) due to unexpected stresses, kinetic energy, and thermal energy (e.g., over-flex of the diaphragm (114), over-pressurization of the liquid chamber (118) during a discharge stroke, additional driving of the shaft (115) beyond the full length of a stroke, solenoid (113) overheating due to excess current), all of which can increase the likelihood of a component failure.

In light of the above, it can be seen that precise solenoid (113) cycling during the intake stroke and discharge stroke may be desirable for both efficiency and longevity. The drive control module (112), shown in more detail in FIG. 3, may be configured to address this goal. The drive control module (112) comprises a signal conditioner (126), a switching circuit (128), and a microprocessor (130). The signal conditioner (126) receives power from the power input (110) and is operable to gather data on the characteristics of received power (e.g., voltage waveform data), pass those characteristics to the microprocessor (130), and pass the received power to the switching circuit (128). The Microprocessor (130) may be configured with a variety of instructions that may be executed to receive, transmit, and manipulate data, and in particular, the microprocessor (130) may be configured to receive power characteristics from the signal conditioner (126), analyze and manipulate those power characteristics, transmit drive signals to the switching circuit (128), and, in some implementations, monitor and receive information from the drive (114) during operation. The switching circuit (128) is operable to, based on drive signals received from the microprocessor (130) and power received from the signal conditioner (126), energize the drive (114) solenoids (113) in order to cause alternating linear movements of the shaft (115).

Figure 3:
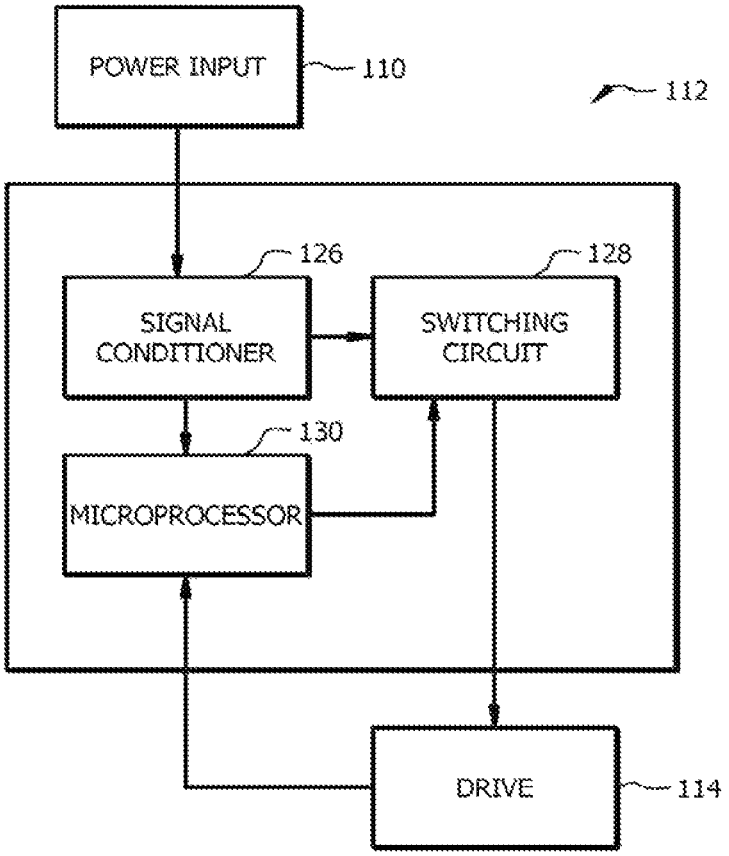
FIG. 3 is a schematic diagram showing the components of an exemplary drive control module.

While FIGS. 2 and 3 show one possible implementation of the pump (100) and drive control module (112) it should be understood that many variations exist and will be apparent to one of ordinary skill in the art in light of the disclosure herein. For example, the drive control module (112) could be placed within a housing of the pump (100) or, in some implementations, could be a separate device attached to the pump via power and/or data connections. As another example, power received via the power input (110) could be passed to the switching circuit (128) and the signal conditioner (126) in parallel rather than in sequence.

Figure 4A:
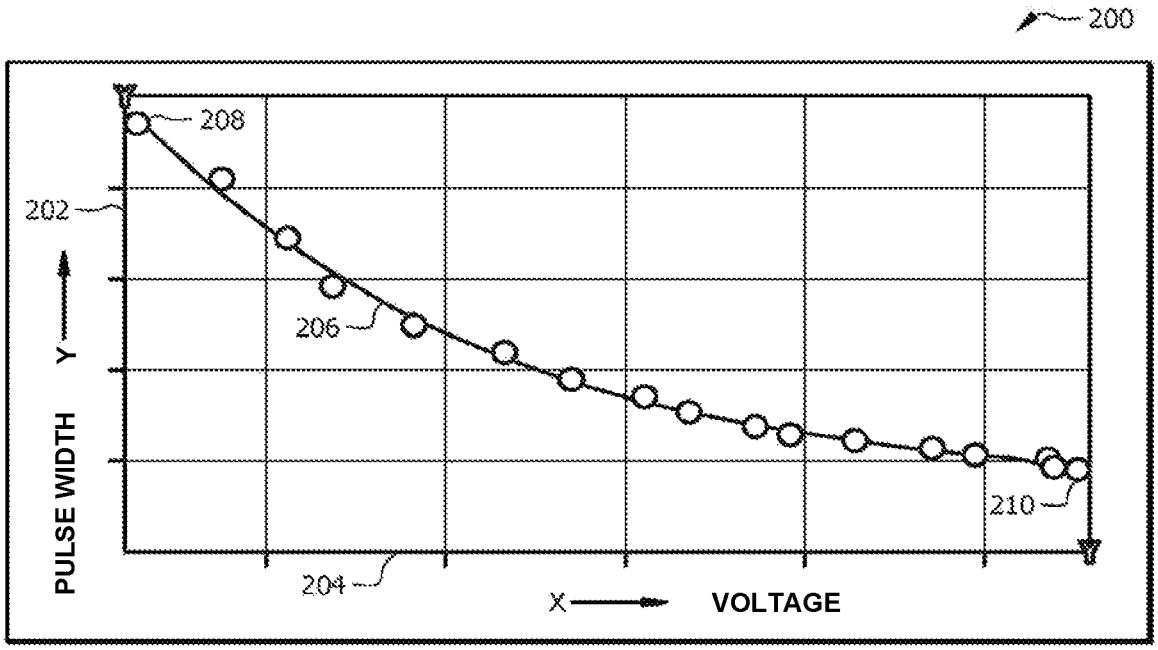
FIG. 4A is a graph showing an exemplary set of coordinates for pulse width (Y-Axis) and voltage (X-Axis)

Referring now to FIG. 4A, that figure is a graph showing an exemplary set of coordinates for pulse width (i.e., the duration of a drive signal during an intake or discharge stroke) along the Y-Axis (202) and voltage along the X-Axis (204). The graph (200) generally represents the relationship between voltage (204) being supplied to the pump by a particular power source and a pulse width (202) that would be appropriate for generating precise and complete intake strokes and discharge strokes. The plotted coordinates (206) represent the curve in which a pump is operating at optimal or near-optimal levels in terms of completing full intake and discharge strokes while also minimizing pulse width and, correspondingly, drive signal duration for each stroke. As can be seen, a lower voltage requires a longer pulse width (e.g., at the left most coordinate (208) voltage (204) is at the minimum level for continued operation of the pump, and pulse width (202) is relatively long to allow for complete strokes) in order to complete a stroke. Inversely, a higher voltage requires a shorter duration of pulse width (e.g., at the right most coordinate (210) voltage (204) is at a relatively high level, and pulse width (202) is much shorter) in order to complete a stroke while minimizing drive signal duration.

Figure 4B:
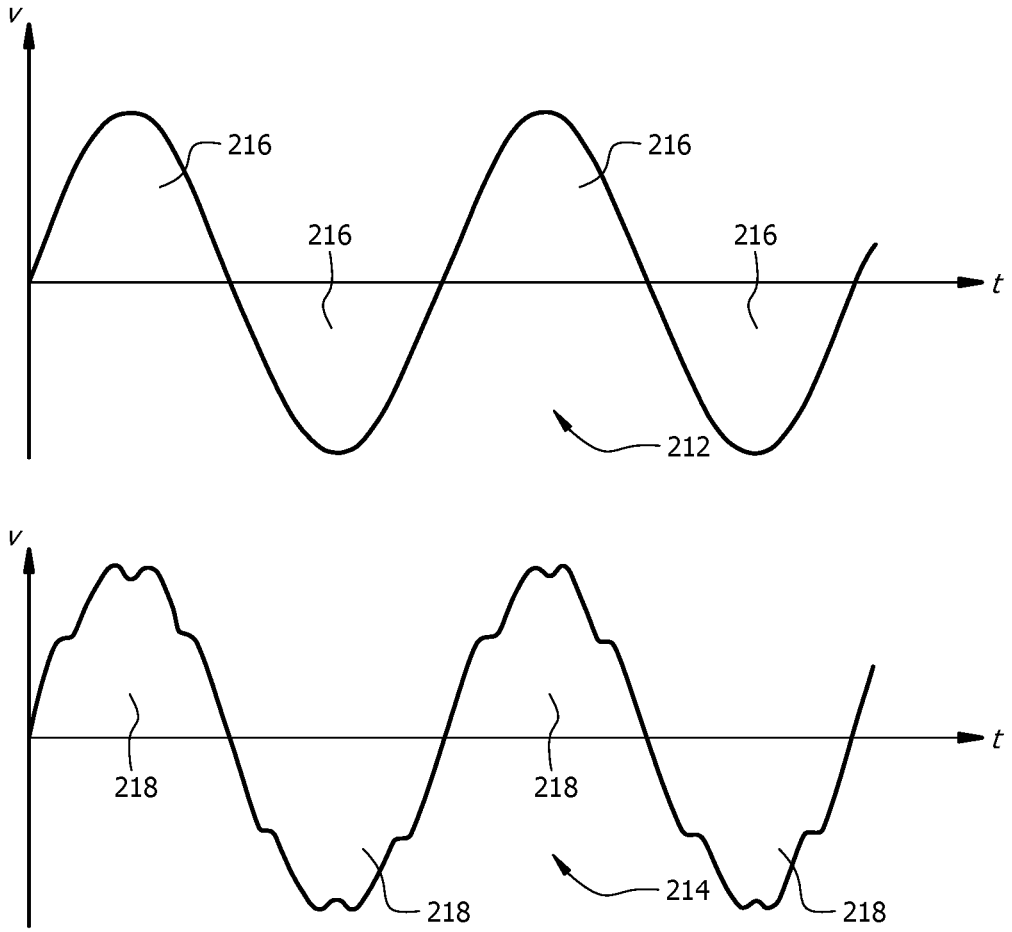
FIG. 4B is a set of exemplary voltage input waveforms, one showing a clean or sinusoidal voltage input and one showing a dirty or non-sinusoidal voltage input.

This can be seen more clearly in the exemplary waveforms shown in FIG. 4B. That figure shows both a sinusoidal waveform (212) and a non-sinusoidal waveform (214), each represented as a graph of input voltage ("V") over time ("t"). The areas under each respective waveform curve (216, 218) represent the amount of power delivered during the time period represented in the waveform. As can be seen by comparing the areas under the waveform curves (216, 218), a non-sinusoidal or noisy waveform (214) will typically deliver less energy for a given peak-to-peak voltage as compared to a sinusoidal waveform (212), even where the input voltage is similar, as in FIG. 4B. As a result, in order to deliver the same amount of energy the pulse width, which roughly corresponding to time or "t" for the shown waveforms, for a non-sinusoidal waveform will be of longer duration as compared to the pulse width of a sinusoidal waveform when both have similar input voltages.

Figure 5:
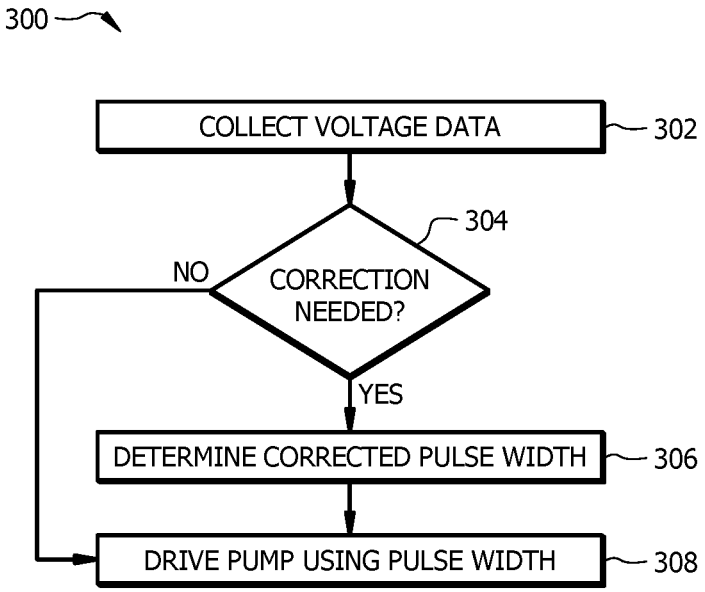
FIG. 5 is a flowchart showing an exemplary set of steps that may be performed to operate a pump with dynamic drive cycle adjustment.

Referring now to FIG. 5, that figure is an exemplary set of steps that may be performed by the microprocessor (130) of a drive control module (112) or another device in order to operate a pump (100) in a manner that substantially matches the characteristics of the plotted coordinates (206) of FIG. 4A. While all of the steps of this method (300) may be performed automatically in some implementations, it should be understood that in other implementations one or more of the shown steps or related steps may be manually performed (e.g., configuring a voltage test interval, triggering a voltage test interval, configuring a polynomial for determining pulse width, etc.) by a person installing or activating the pump (100). Initially, the microprocessor will collect voltage data (block 302) associated with the power source (108) from the signal conditioner (126), voltmeter, or another device. This could include incoming voltage data over a period of time, with the period of time being arbitrary, configurable, or automatically selected in real-time.

Collecting voltage data (block 302) may occur when the pump (100) is first installed, first activated, or regularly during operation based upon a test interval to account for dirty power sources (108) with inconsistent voltage. In some implementations, after voltage data is collected, a determination may be made as to whether a correction of the pulse width is needed (block 304). This could be done by, for example, monitoring the performance of the drive (114) (e.g., by examining sensor data describing the position of the shaft to determine stroke quality), by comparing a set of previously collected voltage data to a more recently collected set of voltage data, or by regularly forcing a refresh of the pulse width. If it is determined that no correction is needed (block 304), the drive control module (112) may continue to drive the pump (100) using the previously configured pulse width (block 308). If it is determined that a correction is needed, the drive control module (112) may determine a corrected pulse width (block 306) and then drive the pump using the corrected pulse width (block 308).

Figure 6:
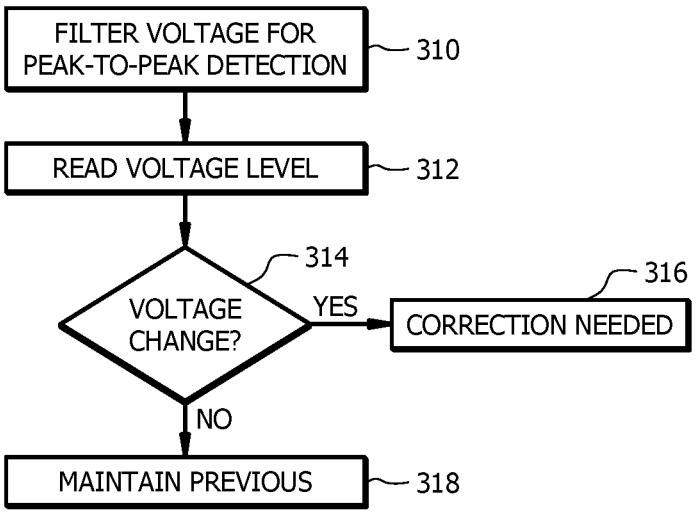
FIG. 6 is a flowchart showing an exemplary set of steps that may be performed to collect voltage data.

Referring to FIG. 6, that figure shows a set of exemplary steps that could be performed by the drive control module (112) to collect voltage data (block 302) and determine if a correction or adaptation is needed (block 304). Power source (108) voltage may be filtered to aid in detection peak-to-peak voltage wavelength (block 310), and to determine voltage level (block 312). If measured characteristics have changed or substantially changed (block 314) since the last determination, or if other factors indicate that pulse width should be re-determined (e.g., regular re-calculation or triggered by drive (114) performance monitoring), the drive control module (112) will determine that a correction is needed (block 316) and take appropriate action (e.g., determine a corrected pulse width (block 306)). If no change is needed, a previous pulse width may be maintained (block 318).

Figure 7:
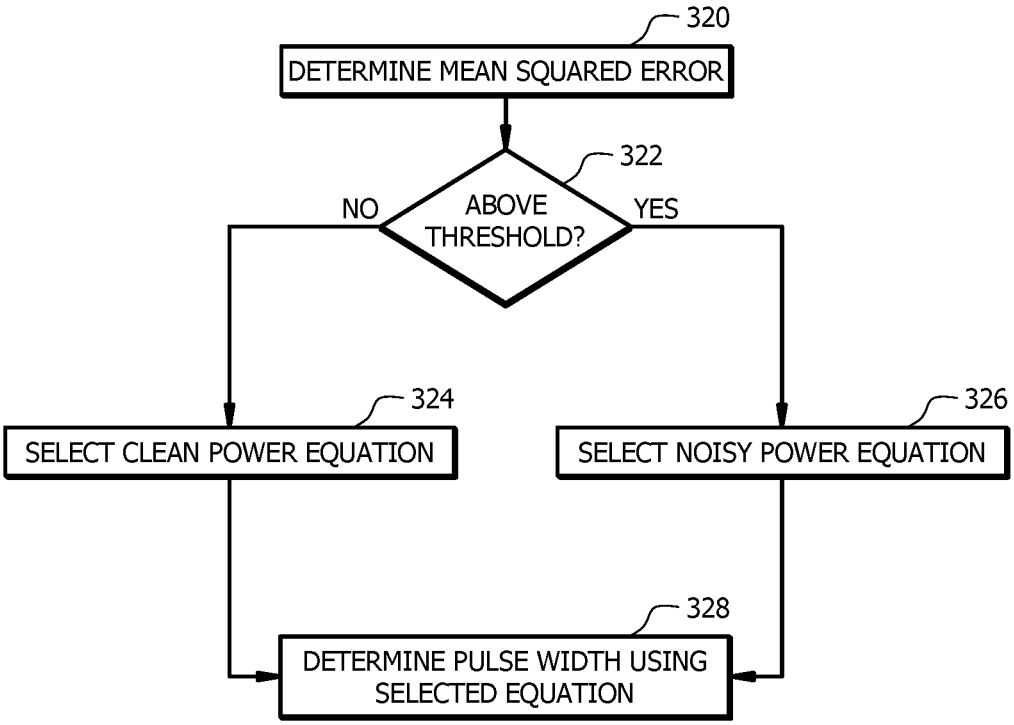
FIG. 7 is a flowchart showing an exemplary set of steps that may be performed to determine pulse width using a means squared error method.

Referring to FIG. 7, that figure shows a set of exemplary steps that could be performed by the drive control module (112) to determine a corrected pulse width (block 306). Using a collected set of voltage data, the drive control module (112) will determine the mean squared error (MSE) (block 320) of the voltage. If the MSE is low, that will be an indication that the input voltage is a stable or sinusoidal waveform. A higher MSE will indicate a noisy or non-sinusoidal waveform. A non-sinusoidal or noisy waveform will typically deliver less energy for a given peak-to-peak voltage as compared to a sinusoidal waveform. As a result, the pulse width for a non-sinusoidal waveform will be of longer duration as compared to the pulse width of a sinusoidal waveform when both have similar input voltages. If the MSE is above a configured threshold (block 322) (e.g., where input voltage is non-sinusoidal), a noisy power equation will be selected (block 326) that may be used to determine, based upon the voltage data, an appropriate pulse width that will compensate for both the input voltage and the non-sinusoidal waveform of the input and allow the pump (100) to operate as shown in the graph (200) of FIG. 4A. If the MSE is below the configured threshold (block 322), a clean power equation will be selected (block 324) that will compensate for the input voltage and allow the pump (100) to operate as shown in the graph (200) of FIG. 4A.

A clean power equation and a dirty power equation may be different to account for the sinusoidal versus non-sinusoidal input voltage. One exemplary clean power equation for a particular pump might be, as an illustrative example, $y=400-250x+60x^2-5x^3$. One exemplary dirty power equation for the same pump will provide longer pulse width durations (i.e., to compensate for non-sinusoidal input voltage) and may be, for example, $y=400-225x+65x^2-4x^3$, or $y=450-250x+60x^2-5X^3$ as another example. It should be noted that, in addition to providing longer pulse width durations, there are situations in which a dirty power equation will provide similar, or even shorter duration pulse widths, as may be desirable for a particular implementation. It should also be noted that these are example values and equations only, as a variety of factors will determine the polynomial equations that a particular pump is configured with or may be selected from. These equations may be configured at the time of manufacture, configured manually at the time of installation or activation, or may be configured automatically in response to drive (114) monitoring or by communication with another device over a network or data connection, for example. Once the equation is selected (block 324, block 326), the drive control module (112) will determine a new pulse width using the selected equation (block 328), and then operate the drive (114) using that pulse width (block 308).

Other methods of determining a new pulse width exist and will be apparent to one of ordinary skill in the art in light of this disclosure. For example, in some implementations, the drive control module (112) may instead determine the root mean squared (RMS) of the input voltage instead of the MSE. In this method, the pulse width can be determined directly without the need for multiple equations to compensate for sinusoidal and non-sinusoidal waveforms. In yet other implementations, the drive (114) may be closely monitored during performance with sensor and performance data (e.g. through sensor 117 illustrated in FIG. 2) being provided to the drive control module (112) in near real-time. Such performance data could include liquid chamber (118) pressure, intake and discharge stroke peak position, output of output check valve (122), thermal rise in solenoids (113) and shaft (115), and other characteristics that could be gathered and would provide an indication of drive (114) performance. This performance data could be used in a feedback loop to continuously adjust pulse width during performance, either by incremental changes or by devising new polynomial equations for determining pulse width in real time. Other similar methods exist, as do variations or combinations of the above-disclosed methods, which are provided for illustration only.

Other variations and implementations on the above disclosed system and method exist. For example, in some implementations a pump (100) may track its active usage and lifecycle and adjust equations used to determine pulse width to account for degrading performance over time. For example, as a shaft, diaphragm, solenoid, or other component ages and undergoes wear from typical use, its performance may also change due to changes in conductivity, flexibility, friction, or motion. Such changes could be accounted for by increasing calculated pulse width over time.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A pump comprising:

a liquid chamber comprising an intake valve and an output valve;

a set of solenoids that may be energized by a drive, in response to drive signals;

a shaft configured to perform an intake stroke or a discharge stroke by operation of the set of solenoids, wherein the intake stroke increases the volume of the liquid chamber and allows liquid to flow through the intake valve and the discharge stroke decreases the volume of the liquid chamber and forces liquid through the output valve; and a drive control module comprising a processor and memory and a voltage measuring circuit, wherein the drive control module is operable to provide drive signals to the set of solenoids;

wherein the drive control module is configured to:

receive a set of voltage data via the voltage measuring circuit;

based on the set of voltage data, determine a corrected pulse width that is of a minimum duration that allows for completion of the intake stroke and the discharge stroke; and generate a drive signal based upon the corrected pulse width and provide it to the drive;

wherein the drive control module is configured to determine the corrected pulse width by:

determining a mean squared error of an input voltage from the set of voltage data;

when the mean squared error is above a noisy power threshold, selecting a noisy power equation as a corrected pulse width equation;

when the mean squared error is below the noisy power threshold, selecting a clean power equation as the corrected pulse width equation; and determining the corrected pulse width based on the corrected pulse width equation and the set of voltage data.

2. The pump of claim 1, wherein the noisy power equation will produce a pulse width of a different duration than the clean power equation when each uses the same set of voltage data.

3. The pump of claim 2, wherein the corrected pulse width equation is a third order polynomial equation.

4. The pump of claim 1, wherein the drive control module is configured to:

receive a set of performance data from the drive, the set of performance data being generated by a set of sensors of the drive during the discharge stroke and the intake stroke; and determine a corrected pulse width based on the set of performance data.

5. The pump of claim 4, wherein the set of performance data comprises three or more of:

a pressure measurement of the liquid chamber;

an intake stroke distance traveled;

a discharge stroke distance traveled;

an intake stroke velocity over time;

a discharge stroke velocity over time; and a drive component temperature.

6. The pump of claim 4, wherein the drive control module is configured to:

receive a new set of performance data each time the corrected pulse width is determined; and determine the corrected pulse width for each new set of performance data that is received.

7. The pump of claim 1, wherein the drive control module is configured to:

periodically receive a new set of voltage data; and where the new set of voltage data differs from an immediately preceding set of voltage data, determine the corrected pulse with based on the new set of voltage data.

8. The pump of claim 7, wherein the drive control module is configured receive the new set of voltage data based upon a test time interval.

9. The pump of claim 1, wherein the drive control module is configured to determine the corrected pulse width for sets of voltage data having an input voltage ranging from 110 volts to 240 volts.

10. The pump of claim 1, wherein the volume of the liquid chamber changes due to one of:

a flexible diaphragm in contact with the liquid chamber and the shaft;

a plunger in contact with the liquid chamber and the shaft; or the displacement volume of the shaft itself entering the liquid chamber.

11. The pump of claim 1, wherein the corrected pulse width is determined based upon the set of voltage data and a set of pump usage data, wherein the set of pump usage data comprises a pump service life and a pump drive activation time.

12. A pump comprising:

a liquid chamber comprising an intake valve and an output valve;

a set of solenoids that may be energized by a drive, in response to drive signals;

a shaft configured to perform an intake stroke or a discharge stroke by operation of the set of solenoids, wherein the intake stroke increases the volume of the liquid chamber and allows liquid to flow through the intake valve and the discharge stroke decreases the volume of the liquid chamber and forces liquid through the output valve; and a drive control module comprising a processor and memory and a voltage measuring circuit, wherein the drive control module is operable to provide drive signals to the set of solenoids;

wherein the drive control module is configured to:

receive a set of voltage data via the voltage measuring circuit;

receive a set of performance data from the drive, the set of performance data being generated by a set of sensors of the drive during the discharge stroke and the intake stroke;

based on the set of voltage data, determine a corrected pulse width that is of a minimum duration that allows for completion of the intake stroke and the discharge stroke by:

determining a mean squared error of an input voltage from the set of voltage data;

when the mean squared error is above a noisy power threshold, selecting a noisy power equation as a corrected pulse width equation;

when the mean squared error is below the noisy power threshold, selecting a clean power equation as the corrected pulse width equation; and determining the corrected pulse width based on the corrected pulse width equation, the set of performance data, and the set of voltage data;

generate a drive signal based upon the corrected pulse width and provide it to the drive;

wherein the noisy power equation will produce a pulse width of a longer duration than the clean power equation when each uses the same set of voltage data.

13. A method for adapting drive signals for a pump comprising the steps:

receiving a set of voltage data via a voltage measuring circuit of a drive control module of the pump;

based on the set of voltage data, determining a corrected pulse width that is of a minimum duration that allows for completion of an intake stroke and a discharge stroke;

generating a drive signal based upon the corrected pulse width and providing the drive signal to a drive of the pump;

wherein the drive is configured to energize a set of solenoids in response to drive signals, and wherein energizing the set of solenoids causes a shaft of the pump to perform an intake strokes that causes liquid to flow into a liquid chamber and discharge strokes that causes liquid to flow out of a liquid chamber; and wherein the step of determining a corrected pulse width comprises the steps of:

determining a mean squared error of an input voltage from the set of voltage data;

when the mean squared error is above a noisy power threshold, selecting a noisy power equation as a corrected pulse width equation;

when the mean squared error is below the noisy power threshold, selecting a clean power equation as the corrected pulse width equation; and determining the corrected pulse width based on the corrected pulse width equation and the set of voltage data.

14. The method of claim 13, wherein the noisy power equation will produce a pulse width of a longer duration than the clean power equation when each uses the same set of voltage data.

15. The method of claim 13, wherein the step of determining a corrected pulse width comprises the steps of:

receiving a set of performance data from the drive, the set of performance data being generated by a set of sensors of the drive during the discharge stroke and the intake stroke; and determining a corrected pulse width based on the set of performance data.

16. The method of claim 15, wherein further comprising the steps of:

receiving a new set of performance data each time the corrected pulse width is determined; and determining the corrected pulse width for each new set of performance data that is received.

* * * * *